US006038720A

United States Patent [19]

Matthews et al.

[11] Patent Number: 6,038,720

[45] Date of Patent: Mar. 21, 2000

[54] ATTACHMENT FOR A SUPPORT PILLOW AND METHODS FOR ITS USE

[75] Inventors: Susan H. Matthews, Evergreen, Colo.; Cecelia O. Levine, El Paso, Tex.

[73] Assignee: Camp Kazoo, Ltd., Golden, Colo.

[21] Appl. No.: 09/246,637

[22] Filed: Feb. 8, 1999

Related U.S. Application Data

[63] Continuation-in-part of application No. 08/831,803, Apr. 9, 1997, abandoned, which is a continuation-in-part of application No. 08/590,653, Jan. 24, 1996, Pat. No. 5,661,861.

[51] Int. Cl.[7] ..... A47G 9/00

[52] U.S. Cl. ..... 5/639; 5/636; 5/655; 5/922

[58] Field of Search ..... 5/636, 490, 482, 5/639, 655, 922, 658, 503.1; D6/601; 446/71

[56] References Cited

U.S. PATENT DOCUMENTS

| | | | |
|---|---|---|---|
| D. 316,793 | 5/1991 | Manjarrez | D6/601 |
| 1,898,272 | 2/1933 | Stern | 4/575.1 |
| 2,078,022 | 4/1937 | Roemer | 5/655 |
| 2,379,340 | 6/1945 | Corbett | 4/185 |
| 3,378,948 | 4/1968 | Gervaise | 5/904 |
| 4,197,604 | 4/1980 | Nakamura | 5/640 |
| 4,227,270 | 10/1980 | Rivera | 5/639 |
| 4,236,264 | 12/1980 | Britzman | 5/644 |
| 4,731,890 | 3/1988 | Roberts | 5/636 |
| 4,914,765 | 4/1990 | Smith | 5/636 |
| 4,959,879 | 10/1990 | Marxhausen | 5/636 |
| 4,968,279 | 11/1990 | Smith | 5/636 |
| 5,118,318 | 6/1992 | Lorizio | 5/639 |
| 5,154,649 | 10/1992 | Pender | 5/655 |
| 5,193,235 | 3/1993 | Kircher | 5/413 R |
| 5,207,791 | 5/1993 | Scherbarth | 273/148 B |
| 5,261,134 | 11/1993 | Matthews | 5/655 |
| 5,467,782 | 11/1995 | Wiseman | 5/636 |
| 5,475,886 | 12/1995 | Mintz | 5/636 |
| 5,519,906 | 5/1996 | Fanto-Chan | 5/631 |
| 5,546,620 | 8/1996 | Matthews | 5/655 |
| 5,581,833 | 12/1996 | Zenoff | 5/655 |
| 5,661,861 | 9/1997 | Matthews | 5/633 |
| 5,718,010 | 2/1998 | Beier | 5/636 |

FOREIGN PATENT DOCUMENTS

| | | | |
|---|---|---|---|
| 2 379 268 | 9/1978 | France | 5/655 |
| 1 508 809 | 4/1978 | United Kingdom | 5/636 |
| WO 94/09689 | 5/1994 | WIPO | 5/655 |

*Primary Examiner*—Alexander Grosz
*Attorney, Agent, or Firm*—Townsend and Townsend and Crew LLP

[57] ABSTRACT

The invention provides an exemplary support pillow and methods for its use. In an exemplary embodiment, a support pillow includes a resilient cushion body and an attachment member that is removably attached about the cushion body. The attachment member has at least one connector which is adapted to hold an article near the cushion body.

19 Claims, 11 Drawing Sheets

Fig. 12
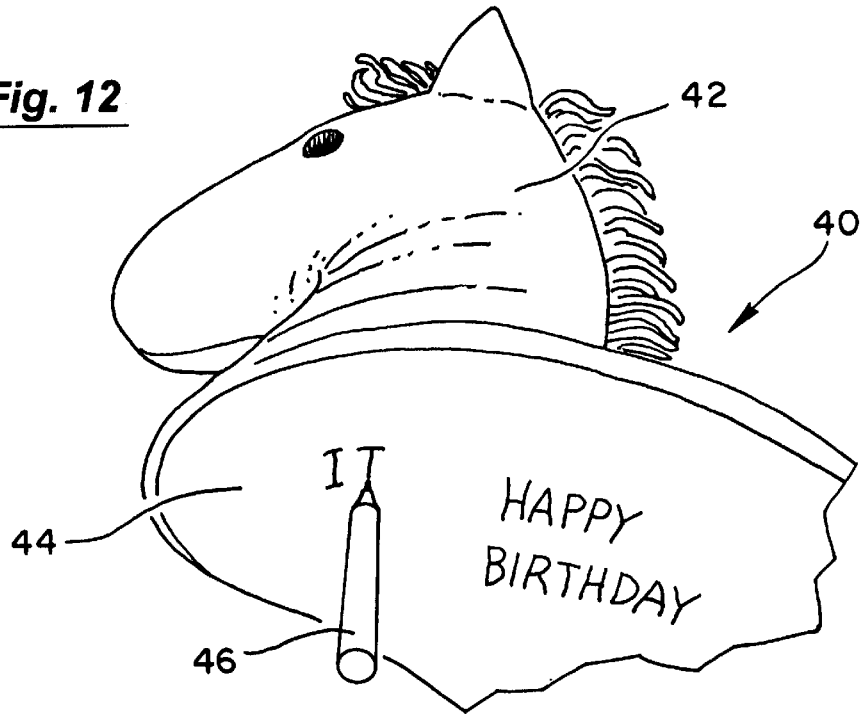
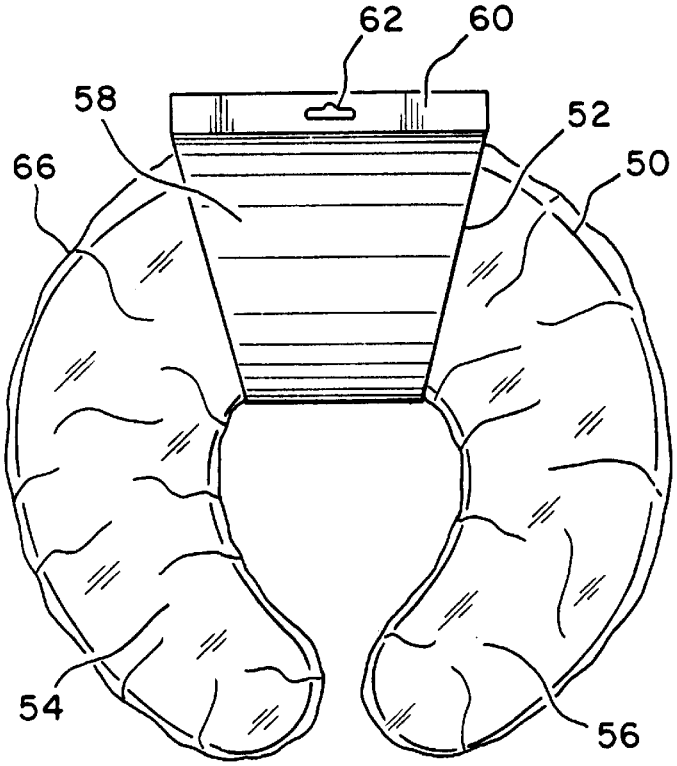
Fig. 13
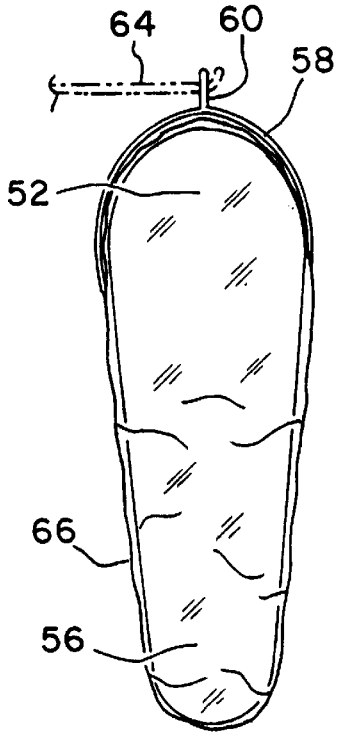
Fig. 14

Fig. 19
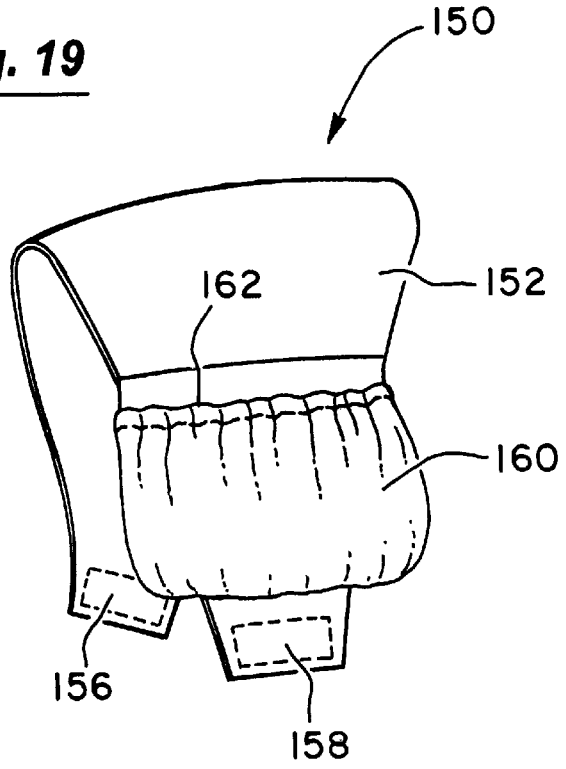
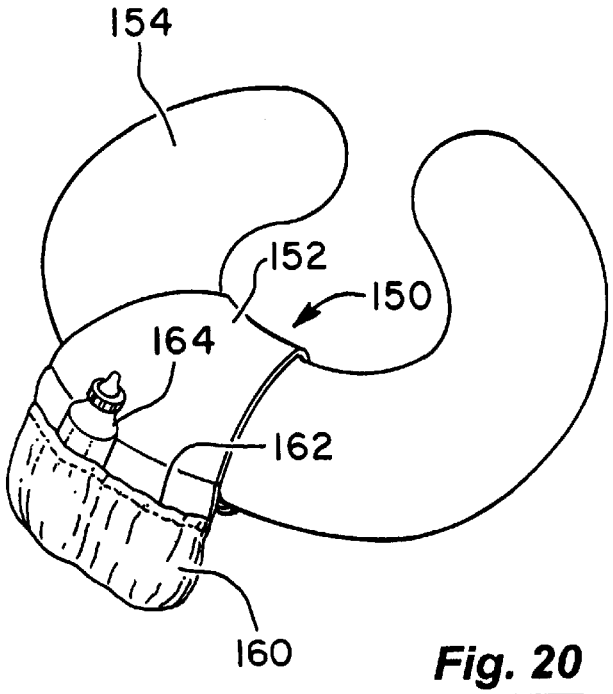
Fig. 20

ATTACHMENT FOR A SUPPORT PILLOW AND METHODS FOR ITS USE

CROSS-REFERENCE TO RELATED APPLICATIONS

This application is a continuation-in-part application of U.S. patent application Ser. No. 08/831,803, filed Apr. 9, 1997, now abandoned which is a continuation-in-part application of U.S. patent application Ser. No. 08/590,653, filed Jan. 24, 1996, now U.S. Pat. No. 5,661,861 the complete disclosures of which are herein incorporated by reference.

BACKGROUND OF THE INVENTION

The present invention relates generally to the field of therapeutic support pillows, and in particular to support pillows and methods for their use which are intended as improvements to the support pillow and methods described in U.S. Pat. No. 5,261,134, the complete disclosure of which is herein incorporated by reference.

U.S. Pat. No. 5,261,134 describes a therapeutic support pillow which is provided to support a small child or an infant, and particularly to hold a small child in a manner that prohibits lateral movement. Although the support pillow described in U.S. Pat. No. 5,261,134 has been generally successful when used to prohibit the lateral movement of a small child, various improvements are desired. For example, it would be desirable if such a support pillow could be used with an adolescent or an adult. For some applications, it would be further desirable if improvements could be made to the overall structure of the support pillow.

Many adults or adolescents participate in activities which make it desirable to support certain objects or body parts. For example, with activities such as reading, typing, breast feeding, and the like, it is often desirable to support the arms or elbows. As another example, when sleeping in an upright position it is often desirable to have the neck and head supported. As a further example, it is often desirable to provide support to the lower back.

Although some support structures have been proposed for supporting objects or body parts, such as the arms of a chair or certain braces, such structures are often uncomfortable and inconvenient to use. Further, some support structures are not easily portable, thereby limiting their use. In a further drawback, most support structures are designed only for a particular application and do not have multiple uses.

For these and other reasons, it would be desirable to provide an improved support pillow and methods which would overcome these and other drawbacks. In particular, it would be desirable if such a support structure and methods were capable of supporting certain small objects or body parts, such as the arms, elbows, lower back, neck or head. Such a support pillow and methods should be comfortable, portable, and easy to use. In one particular aspect, it would be desirable if such a support pillow could be used in a variety of applications to support certain objects or body parts.

SUMMARY OF THE INVENTION

The invention provides a support pillow and methods for its use. In one exemplary method, support is provided to a person's lower back. According to this method, a support pillow is provided having a resilient cushion body with a medial region and first and second opposing cantilever arms extending from the medial region. The cantilever arms have respective first and second end portions remote from the medial region. The cantilever arms are curved about a vertical access to define a substantially toroidal configuration for the cushion body and to position the first and second end portions in a confronting relation to one another. The cantilever arms and medial region cooperate to define a generally circular open well. Such a support pillow is placed around the person's torso in the area of the lower back. The first and second end portions of the cantilever arms are positioned in front of the person's torso, and the medial region of the support pillow is positioned adjacent the person's lower back. The cantilever arms are biased around the person's torso to hold the support pillow vertically positioned relative to the person's torso while the medial region is positioned against the person's lower back. In this manner, the support pillow may be employed to support the person's lower back even when the person is in various positions. For example, the support pillow may be used to support the lower back when the person is sitting in an upright position, such as when sitting in a chair. Alternatively, the support pillow may provide support to the person's lower back while the person is lying.

In one particular aspect, the support pillow is removably held within a flexible container having a bottom end, at least one side and an open top. A base member is held within the bottom end of the container. With this configuration, the base member holds the container in a vertical orientation when the bottom end rests upon a surface, thereby providing a convenient way to store the support pillow. To use the support pillow, the user simply removes the support pillow from the container and then places the pillow around the torso. Preferably, the container comprises a clear polymer and the base member is constructed of a paper material. optionally, the top end may be provided with a snapable handle which provides a way to both carry the pillow and to close the top end of the container.

In another exemplary method, such a support pillow may be placed around the person's torso, with the first and second end portions of the cantilever arms being at the back of the person's torso, and with the medial region of the support pillow being adjacent the front of the person's torso. The cantilever arms are biased around the person's torso to hold the support pillow vertically positioned relative to the person's torso. With the support pillow placed around the person's torso in this manner, an object may be rested on the cantilever arms or the medial region while the cantilever arms are biased around the person's torso.

For example, the person may be sitting while resting the object on the cantilever arms. In one exemplary aspect, the object is printed material, such as a book, that is rested on the medial region. Alternatively, other objects such as games, food, video game controls, and the like, may be rested on the medial region. In a further aspect, the person's elbows or forearms are rested on the medial region. Resting of the person's forearms or elbows in this manner is advantageous when performing a variety of activities with the hands, such as typing on a keyboard, breast feeding a baby, and the like.

In yet another exemplary method, such a support pillow is provided to support a person's neck and head. According to the method, the support pillow is placed around the person's neck with the first and second end portions of the cantilever arms being at the front of the person's neck. The medial region of the support pillow is positioned adjacent the back of the person's neck. The cantilever arms extend around the person's neck so that the neck is supported at least in part by the cantilever arms in the medial region.

In one aspect, the support pillow is positioned so that the cantilever arms rest on the person's shoulders. In another aspect, the person's head is tilted so as to rest the person's neck and head against the support pillow in the region of the open well. For example, the support pillow may be employed to support the person's neck and head while sitting in a chair or other location where the person's head may be supported when titled. Alternatively, the support pillow may be employed to support the person's neck while lying down.

The invention provides an exemplary support pillow having a resilient cushion body, a medial region and first and second opposing cantilever arms extending from the medial region. The cantilever arms have respective first and second end portions remote from the medial region. The cantilever arms are curved about a vertical axis to define a substantially toroidal configuration for the cushion body and to position the first and second end portions in a confronting relation to one another. The cantilever arms and medial region cooperate to define a generally circular open well. At least a portion of the cushion body is covered with a material suitable for receiving a marking substance from a writing instrument such as a pen, marker, or the like. Preferably, such a material comprises a fabric having a smooth surface (such as satin, rip-stop nylon, and the like) and covers a bottom portion of the cushion body. In this way, the support pillow may be employed to receive an autograph or other message by simply turning the support pillow on its side or top and writing on the bottom portion.

In a preferable aspect, a head member is further provided and is attached to the cushion body. The head member will preferably be attached to one of the cantilever arms such that the head member extends in a direction generally parallel to the vertical axis. In one particular aspect, the head member is in the shape of a unicorn.

The invention provides one particularly preferable embodiment of a support pillow which may be used in a liquid medium, such as water. The support pillow comprises a resilient cushion body having a medial region and first and second opposing cantilever arms extending from the medial region. The cantilever arms have respective first and second end portions remote from the medial region, with the cantilever arms being curved about a vertical axis to define a substantially toroidal configuration for the cushion body and to position the first and second end portions in a confronting relation to one another. The cantilever arms and medial region cooperate to define a generally circular open well. The cushion body is constructed of a sponge material so that the cushion body may be placed in a liquid medium. In this way, the support pillow may be placed around the torso of a person when bathing, with the support pillow maintaining the person in a generally upright position. Alternatively, the support pillow may be placed on the bottom of the bath tub, with the person's head being supported by the medial region.

The invention still further provides a support pillow which conveniently may be provided in kit form. The pillow comprises a pillow body having a medial region and a pair of opposing arms. Further, a central holder is removably secured to the medial region of the pillow body to provide a convenient way to carry and store the support pillow.

In one particular aspect, the central holder comprises a piece of material, such as a paper product, which encircles the medial region. Preferably, the holder includes at least one aperture which is adapted to receive a hanger to hang the support pillow, thereby providing a convenient way to both store and display the support pillow. Optionally, a protective cover, such as a plastic, may be provided to encompass the support pillow.

The invention further provides an exemplary method for storing a support pillow having two opposing arms and a medial region. According to the method, a central holder is placed around the medial region and a hanger is introduced through the central holder to allow the support pillow to hang from the hanger. In this way, the hanger may be employed to conveniently store and display the support pillow. For example, the support pillow may be display along a store aisle to allow a purchaser to easily visualize the support pillow and then remove the support pillow from hanger for purchase.

In a further exemplary embodiment, a support pillow is provided comprising a resilient cushion body and at least one connector, such as a strap, which is attached to the cushion body. The strap is configured to attach an article, such as a child's toy, to the cushion body.

The connector may either be fixedly or removably attached to the cushion body. When removably attached, the connector is preferably affixed to an attachment member which in turn is removably coupled to the support pillow. In one preferable embodiment, the attachment member comprises a cover which is wrapped about at least a portion of the support pillow. Conveniently, a fastener, such as a hook and loop fastener material, may be disposed at opposing ends of the cover so that when the cover is wrapped about the support pillow, the ends will overlap to engage the fasteners.

In a preferable aspect, the pillow (or attachment member) includes two or more straps so that a variety of toys may be attached to the pillow. Further, the pillow is preferably fashioned to include a medial region and first and second arms extending from the medial region to define a generally circular open well. With this arrangement, the straps are attached to the medial region so that a child may lay on the pillow, with the stomach being over the well, and play with the toys that are attached to the pillow. The straps are therefore advantageous in that they hold the toys close to the pillow so that the child will not push the toys out of reach during play. When the straps are affixed to the cover, the cover is preferably configured to wrap around the medial region.

The straps may be configured in a variety of ways to hold the toys to the pillow. For example, the toys could be tied to the pillow with the straps. Preferably, each strap will include a fastener which allows the strap to be formed into a loop to secure the article. For instance, each strap may be provided with a hook and loop fastener. In this way, the toys will be removably attached to the pillow to allow for convenient removal and replacement of the toys.

In still another embodiment, an alternative attachment member is provided. This attachment member includes a pocket to hold various articles, such as a bottle, toys, a pacifier, and the like. The attachment member is preferably attached to the support pillow by wrapping the attachment member about a portion of the support pillow and fastening together two ends of the attachment member.

BRIEF DESCRIPTION OF THE DRAWINGS

FIG. 12 illustrates a bottom portion of the support pillow of FIG. 9 which is constructed of a material suitable for receiving a marking substance from a writing instrument according to the present invention.

FIG. 13 is a front view of a support pillow having a central holder to allow the support pillow to be conveniently hung and displayed according to the invention.

FIG. 14 is a side view of the support pillow of FIG. 13.

FIG. 19 is a perspective view of an attachment member having a pocket for holding various articles according to the invention.

FIG. 20 illustrates the attachment member of FIG. 19 when coupled to a support pillow and when holding an article according to the invention.

DETAILED DESCRIPTION OF THE SPECIFIC EMBODIMENTS

Figure 1:
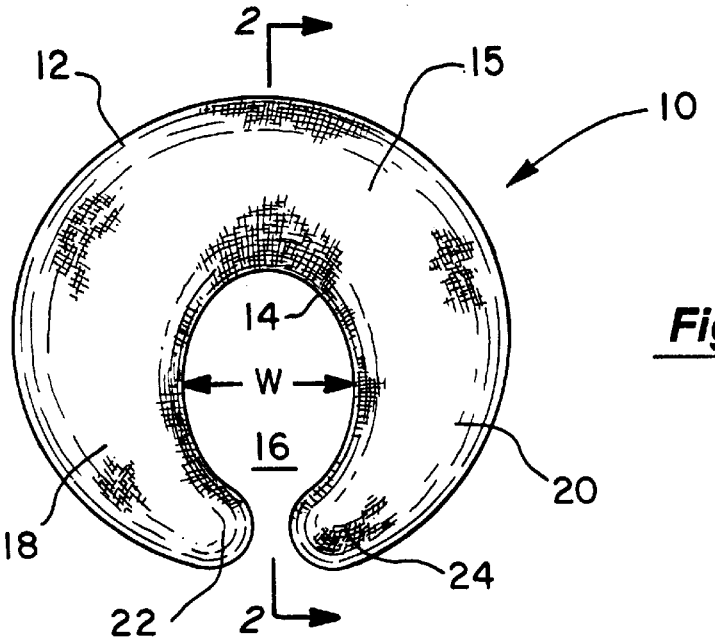
FIG. 1 is a top view of a support pillow constructed in accordance with the present invention.

Referring to FIG. 1, an exemplary embodiment of a support pillow 10 will be described. The support pillow 10 may be constructed essentially identically to the support pillow described in U.S. Pat. No. 5,261,134, previously incorporated herein by reference. The support pillow 10 includes a curved outer surface 12 which is rounded in both a longitudinal and a lateral direction. The support pillow 10 further includes a curved central inner surface 14 which defines a rounded, generally circular or elliptical well region 16. While the body of the support pillow 10 is substantially continuous and uniform, with curved surfaces 12 and 14 also being continuous, it is convenient to consider the pillow body as consisting of a medial region 15, and two opposed cantilever arms 18 and 20. The arms 18, 20 extend in opposite directions away from the medial region 15, but are curved towards one another to give the pillow 10 its toroidal configuration. While the continuous structure does not provide a precise or exact division between the medial region 15 and each arm, considering the body of the pillow in view of these components facilitates a description of the structure and function of the pillow 10.

Cantilever arms 18, 20 include respective blunt ends 20 and 24, positioned remotely of the remedial region. The support pillow 10 is proportioned so that ends 22, 24 normally, i.e., when not under external stress, touch one another. However, the ends 22, 24 do not exert substantial pressure against each other. The toroidal shape defined by the outer and inner curved surfaces 12, 14 is proportioned such that at a central vertical plane, represented by line 2—2 in FIG. 1, bisects the pillow 10 at the medial region 15. Pillow 10 thus has bilateral symmetry with respect to the central plane. The central plane further contains a vertical, central axis about which the toroidal pillow body is formed. Profiles of the pillow 10 taken radially of the central axis, i.e., sections of the pillow 10 in planes that also contain the central axis, are elliptical in shape throughout the medial region, and likewise are elliptical throughout the length of each cantilever arm 18, 20 with the exception of blunt ends 22, 24.

Well region 16 has a width W in the direction perpendicular to the central plane. The width W will preferably be in the range from about four to about twelve inches, and more preferably from about four to about eight inches, with a particularly preferred width being about six inches. Such a width will enable the support pillow to fit "snug" around the torso or waist of most users. The pillow preferably has a circumference of about 15 to 30 inches, and more preferably about 21 inches. As will be described in greater detail hereinafter, the pillow 10 is constructed so that the arms 18, 20 may be moved away from each other to vary the width W so that the pillow 10 may be used in a variety of applications.

Figure 2:
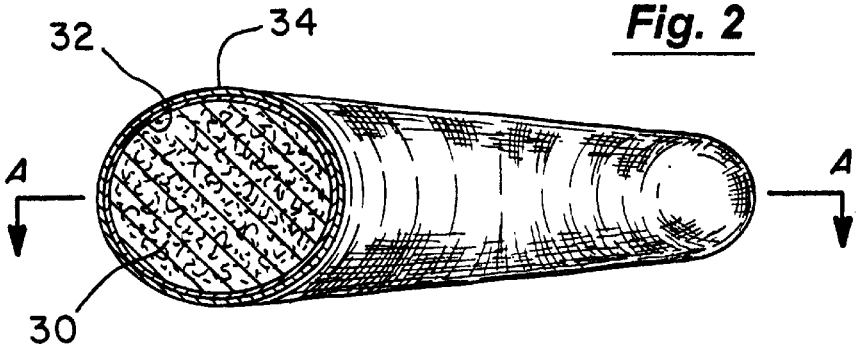
FIG. 2 is a cross-sectional side view of the support pillow of FIG. 1 taken along lines 2—2.

Referring to FIG. 2, the pillow 10 includes a central core 30 which is constructed of a resilient, compression resistant, hypoallergenic material, such as a polyester filling. The central core 30 is encased in a lining 32, such as cotton or other pliant conforming fabric. The polyester is firmly and tightly packed into lining 32, such that the core 30 and lining 32 together provide a self-supporting pillow body, i.e., the support pillow 10 retains its shape without any sagging or drooping of the cantilever arms 18, 20 when held at the medial region 15. The tightly packed polyester core 30 also provides the pillow with firmness in the sense that it will undergo only slight elastic deformation (as compared to a conventional pillow) when an object (such as a persons' arms or elbows) is rested on the arms 18,20 or medial region. Covering the lining 32 is a conforming, removable exterior covering 34, also preferably constructed of cotton. The elliptical profile i.e., the profile in the central plane, preferably has a vertical height of about four to eight inches, and preferably at about six inches. Line A—A in FIG. 2 represents a horizontal mid-plane, with the top and bottom halves of pillow 10 being symmetrical about the mid-plane.

Figure 3:
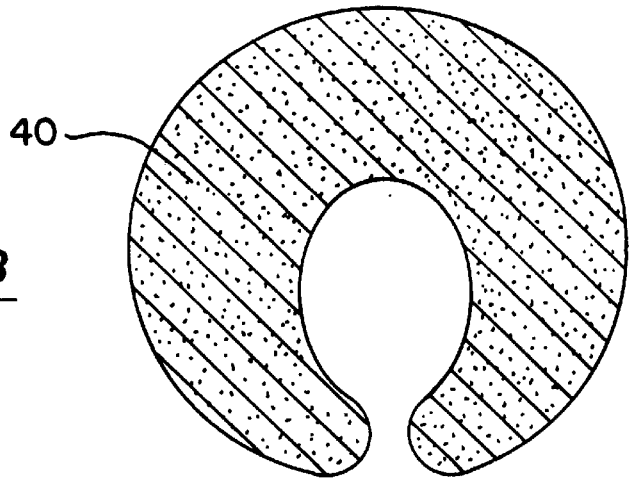
FIG. 3 is a cross-sectional top view of an alternative embodiment of a support pillow according to the present invention.

FIG. 3 illustrates an alternative embodiment of a support pillow 40. Support pillow 40 is constructed of a sponge material or other porous material (such as a foamed rubber). The sponge material will preferably provide substantially the same type of support as described in connection with the support pillow of FIG. 1. Constructing the pillow 40 of a sponge material allows the support pillow to be placed in liquids, such as water. For example, the support pillow may be placed around the waist or torso of a person (particularly an infant or a small child) when bathing. The support pillow holds the person upright to prevent the person from falling or slipping while within the bathtub. This is particularly advantageous when attempting to bathe a small child, who may be slippery due to water or soap on the skin. After bathing, the support pillow may be removed from the person, wrung out, and left in the tub to dry.

Figure 3A:
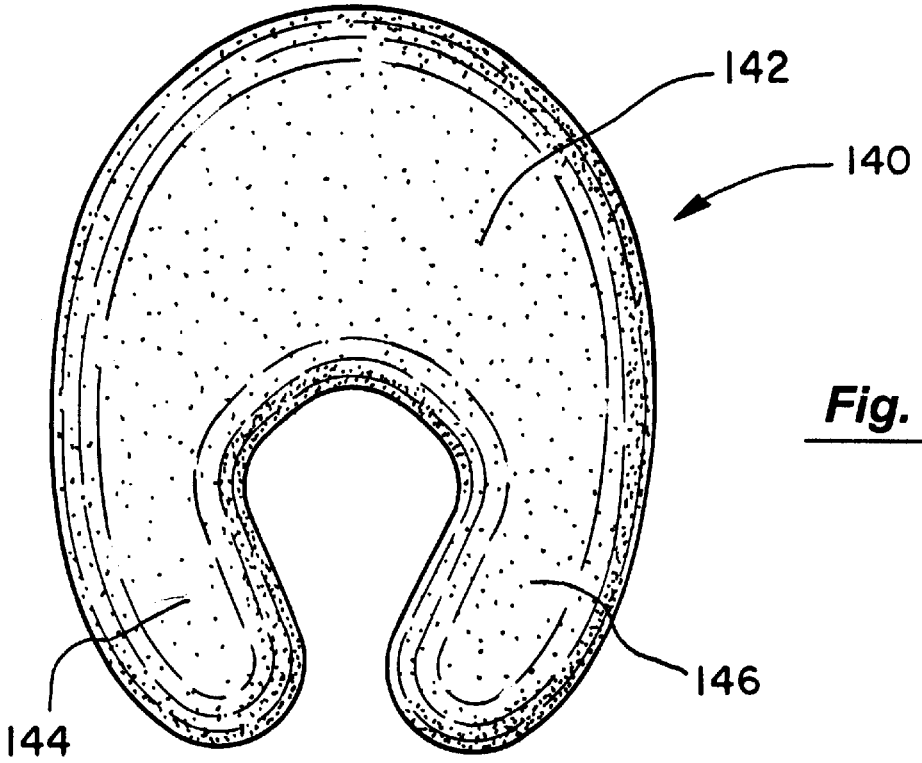
FIG. 3A is a top view of a further alternative embodiment of a support pillow according to the invention.
Figure 3B:
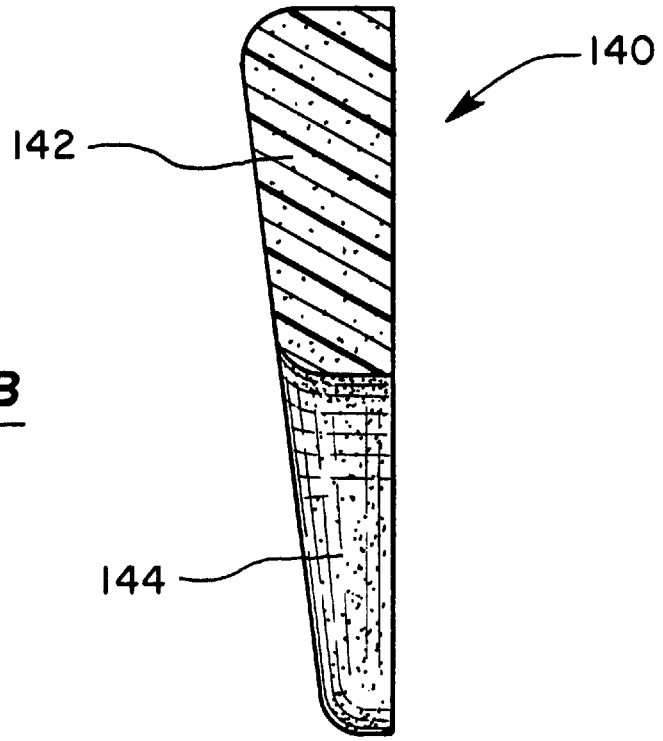
FIG. 3B is a cross-sectional side view of the support pillow of FIG. 3A.

Referring to FIGS. 3A and 3B, an alternative embodiment of a support pillow 140 which may be used in a liquid environment, such as when bathing, will be described. Support pillow 140 is preferably constructed of a sponge material, polyurethane foam or the like so that it may be used in water. Alternatively, support pillow 140 may be inflatable to its illustrated configuration. For example, the pillow may be constructed of a rubber or vinyl material which is inflated similar to pool toys.

Pillow 140 includes a medial region 142 and a pair of arms 144 and 146. As best shown in FIG. 3B, pillow 140 tapers from medial region 142 to arms 144 and 146. Also, arms 144 and 146 are spaced apart from each other. When configured in this manner, pillow 140 will preferably be used by placing the pillow on a bottom surface of a bath tub, large sink, or the like. A person is then placed on their back, with medial region 142 supporting the head. Pillow 142 will preferably have a height sufficient to keep the person's head from being covered by water when in such a position. With an infant or small child, arms 144 and 146 will tend to hold the person's torso stationary so that they will not roll off pillow 140. Optionally, pillow 140 could be placed around a person's waist similar to the other embodiments described herein. Also, a person could lay supine or sideways on the pillow.

Although the size of pillow 140 will vary depending on the size of the person using the pillow, some exemplary size ranges are as follows. Medial region 142 will preferably have a depth in the range from about 4 inches to about 15 inches, and more preferably about 9 inches. Arms 144 and 146 will preferably be spaced-apart by about 0.5 inch to about 6inches, and more preferably at about 3 inches. Medial region 142 will preferably have an average thickness of about 2 to about 6 inches, and more preferably about 4 inches.

Figure 4:
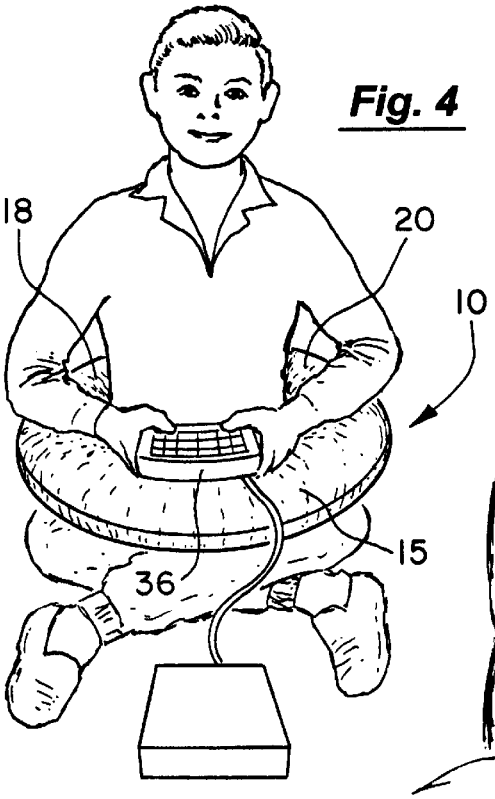
FIGS. 4 and 5 illustrate one exemplary use of the support pillow of FIG. 1 when placed around a person while in a sitting position.
Figure 5:
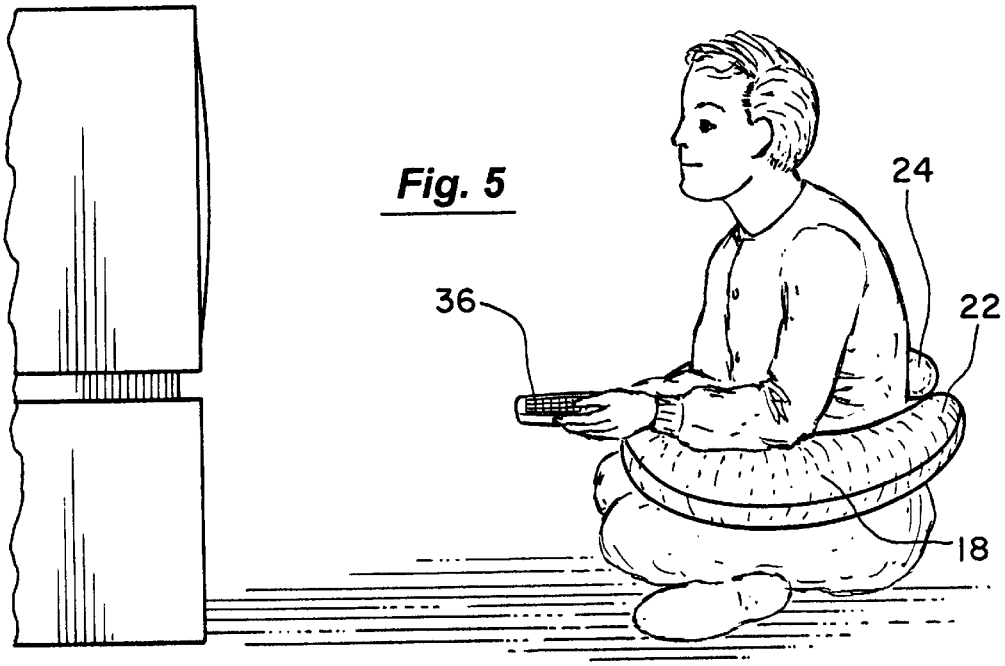

Referring now to FIGS. 4 and 5, an exemplary method for using the support pillow 10 will be described. In FIGS. 4 and 5, the support pillow 10 is placed around a person's torso with the medial region 15 being at the front of the person's torso. The cantilever arms 18, 20 extend around the side of the person's torso, with the ends 22, 24 being at the back of the person's torso. As previously described, the arms 18, 20 are resilient so that they may be moved away from each other. In this way, the pillow 10 may be positioned around the person's torso by grasping the arms 18, 20 and pulling them away from each other while sliding the ends 22, 24 around the person's torso. The arms 18, 20 are sufficiently biased so that the pillow 10 will remain vertically secured to the person's torso by the arms 18, 20. Preferably, the support pillow 10 will be positioned around the person's torso just above the waist, with the waist and the person's thighs helping to prevent the support pillow 10 from sliding down the person's waist when a force is applied to the top surface of the pillow 10.

In FIGS. 4 and 5, the person is in a sitting position, with the bottom of the support pillow 10 resting upon the person's knees and legs. In this configuration, the person may rest the elbows or forearms on the cantilever arms 18, 20 and/or the medial region 15 to support the person's arms while operating a keyboard 36, a computer game, an electronic device, or the like 36. When resting the elbows and/or the forearms on the support pillow 10, the support pillow 10 will experience only slight deformation so that sufficient support is provided to the person's arms while also providing a comfortable support surface. Optionally, the keyboard 36 itself may be directly rested on the support pillow 10, such as on the medial region 15 when operating the keyboard 36.

The support pillow 10 will preferably be constructed so that a single size may be used for most people. In some circumstances, however, it may be advantageous to vary the dimensions of the pillow 10 to fit the particular person.

Figure 6:
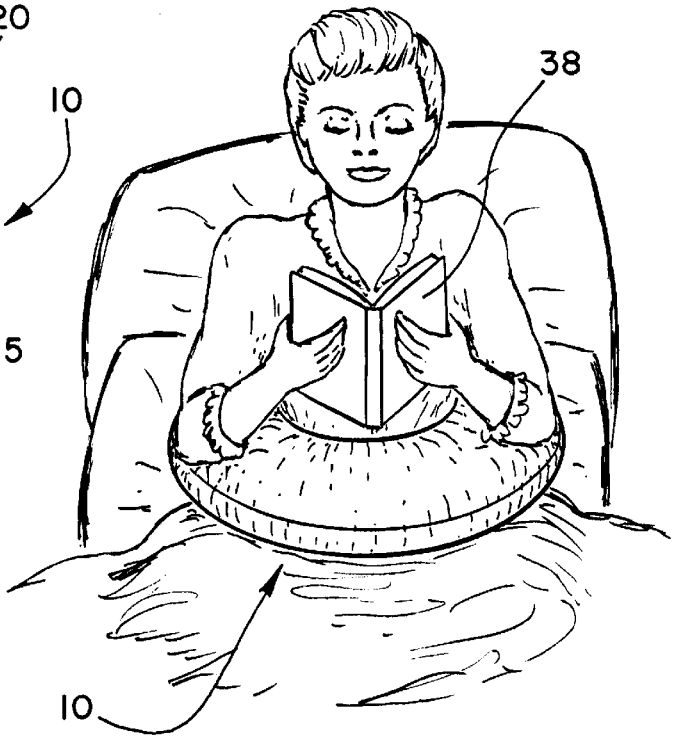
FIG. 6 illustrates a further exemplary method for using the support pillow of FIG. 1 to support an object in front of a person's torso according to the present invention.

Referring to FIG. 6, an alternative use of the support pillow 10 will be described. In FIG. 6, the support pillow 10 is placed around a person's torso in a manner similar as that previously described in FIGS. 4 and 5. The person will preferably be in a sitting position, with the support pillow 10 around the torso and being supported by the person's thighs. The person's elbows are rested on the support pillow at the cantilever arms 18, 20 or at the medial region 15 to provide support to the person's arms while reading a book 38 or other printed material. The vertical position of the support pillow 10 relative to the person's torso may be adjusted to place the book 30 at a comfortable reading position.

Figure 7:
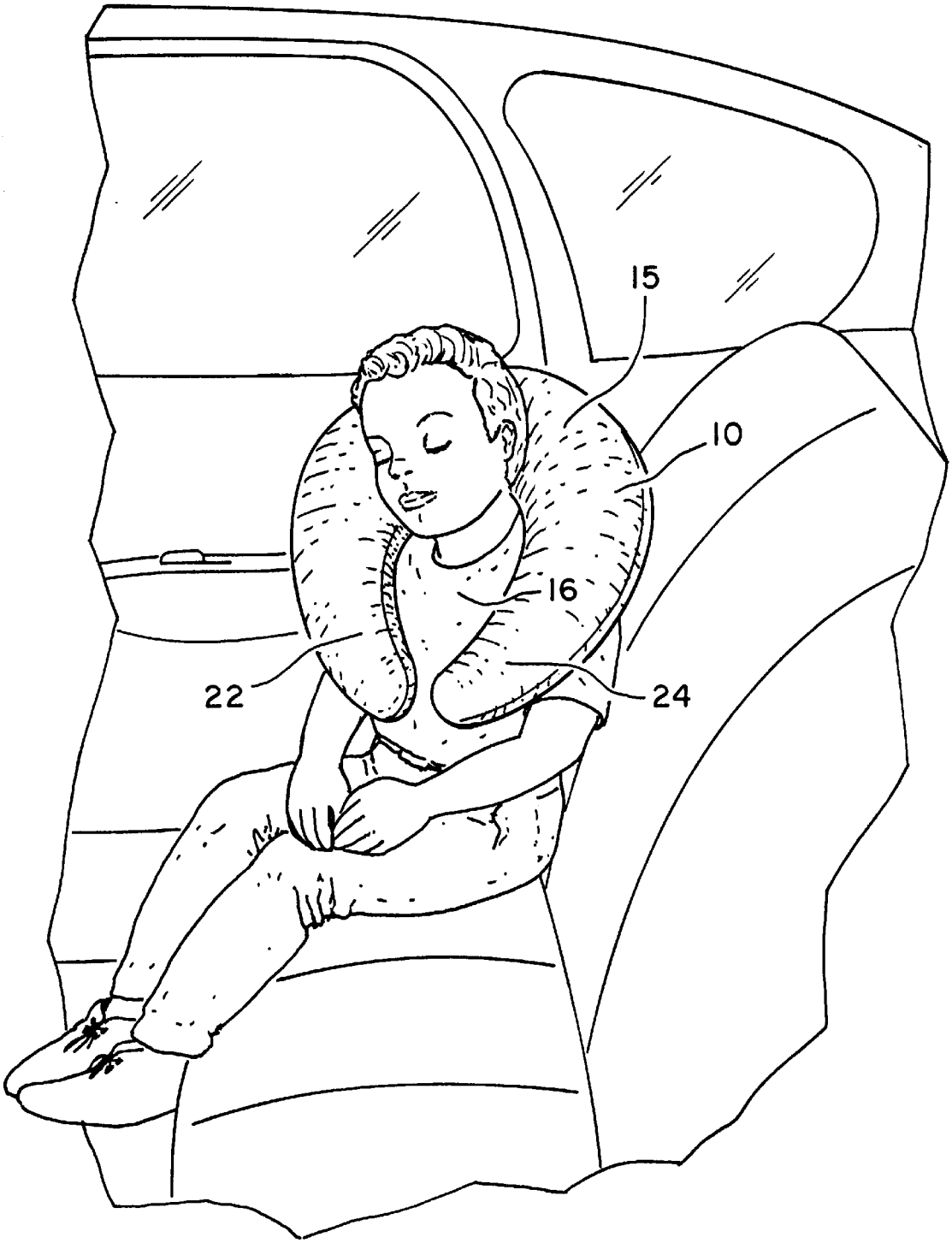
FIG. 7 illustrates yet another use of the support pillow of FIG. 1 for supporting a person's neck and head according to the present invention.

Referring to FIG. 7 still yet another exemplary use of the support pillow 10 will be described. In FIG. 7, the support pillow 10 is placed around a person's neck, with the medial region 15 being at the back of the person's head and the ends 22, 24 being in front of the person's neck. The well region 16 is sufficiently sized so that the support pillow 10 will not choke or interfere with the breathing of the person. The support pillow 10 is placed around the person's neck by pulling the ends 22, 24 away from each other and sliding the ends 22, 24 around the neck. When placed around the neck, the support pillow 10 rests upon the person's shoulders so that when the person's head is tilted, the person's neck or head will rest against the support pillow 10 in the region of the open well 16. The support pillow 10 may be used to support a person's neck or head when the person is in virtually any position, such as lying, sitting, or the like. When around the neck, the support pillow 10 is particularly useful when the person is sitting in a chair or other supporting member, such as when in an airplane or an automobile as shown in FIG. 7. When sitting in an upright position, it is often difficult to sleep comfortably since little support is provided to the head and neck. When the support pillow 10 is around a person's neck, the person may comfortably sleep in an upright position, with the support pillow 10 providing sufficient support to the neck and head.

Figure 8:
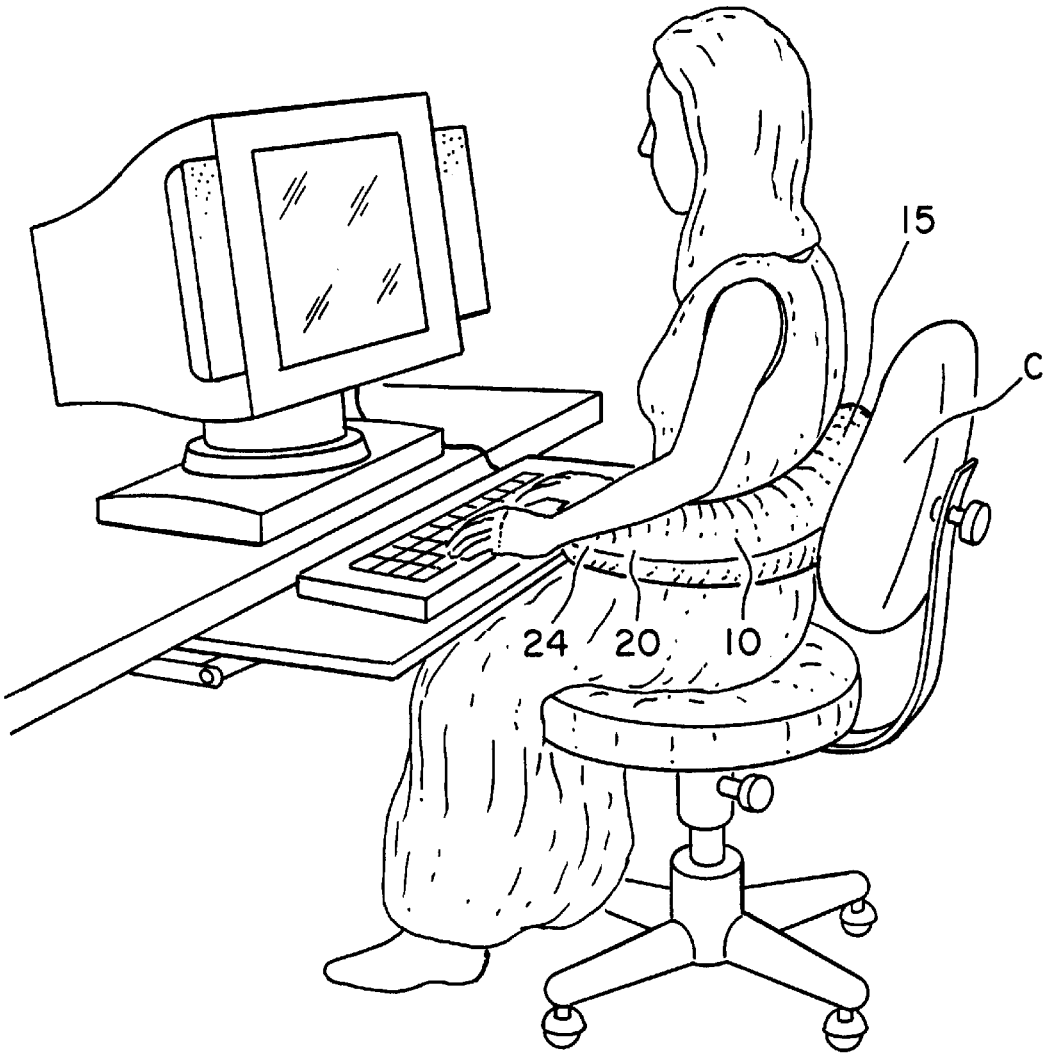
FIG. 8 illustrates still yet another use of the support pillow of FIG. 1 for supporting a person's lower back according to the present invention.

Referring to FIG. 8, still yet another exemplary method for using the support pillow 10 will be described. In FIG. 8, the support pillow 10 is placed around a person's torso with the medial region 15 being at the back of the person's torso, and the ends, 22, 24 being at the front of the person's torso. The medial region 15 will preferably be positioned in the area of the lower back, such as at the lumbar region, so that the support pillow may provide support to the person's lower back. The support pillow 10 is placed around the person's torso in a manner similar to that previously described in connection with FIGS. 4 and 5. The arms 18, 20 are sufficiently resilient so as to hold the support pillow in a constant vertical position relative to the person's torso.

The support pillow 10 may be used to provide support to the lower back when the person is in a variety of positions, such as when lying, sitting, and the like. The support pillow 10 will be particularly useful when sitting in a chair C with the outside surface 12 of the pillow being positioned against the back of the chair C. In this way, the inner surface 14 will be biased against the person's lower back. The support pillow 10 will undergo only slight elastic deformation when positioned against the person's back so that sufficient support will be provided to the lower back. At the same time, the support pillow 10 is sufficiently resilient so that the support will be comfortable to the person. A further advantage of support pillow 10 is that it will snugly fit around the person's torso so that when the person twists or moves about, the support pillow 10 will generally maintain its position about the person's torso. As shown in FIG. 8, arms 22, 24 are available to support the person's arms, such as when typing.

Figure 9:
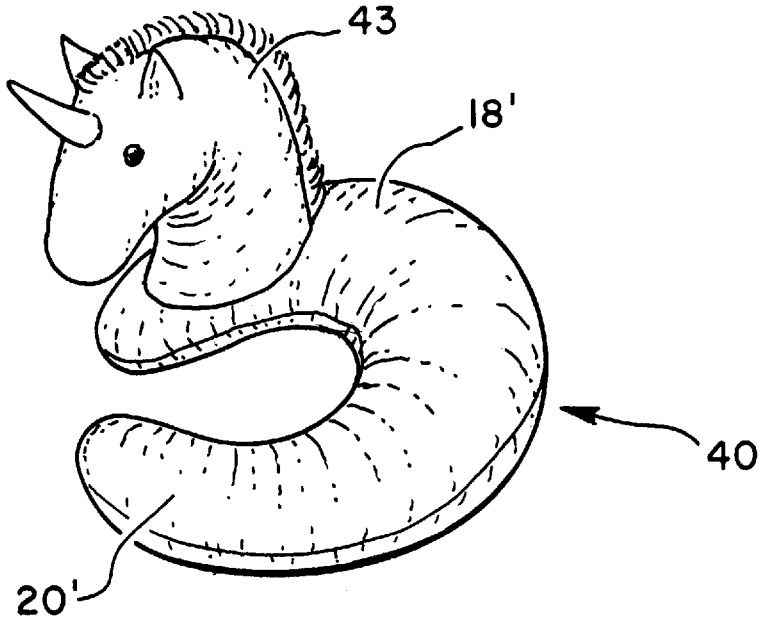
FIG. 9 illustrates an alternative embodiment of a support pillow having a head member attached to one of the cantilever arms according to the present invention.

Referring to FIG. 9, an alternative embodiment of a support pillow 40 will be described. The support pillow 40 may be constructed essentially identically to the support pillow of FIGS. 1–3 except that the support pillow 40 includes a head member 42 which is attached to one of the cantilever arms 18'. Alternatively, the head member 42 may be attached to the pillow 10 anywhere along the top surface, with the head member 42 preferably being generally parallel to a vertical axis of the support pillow 40. Although shown with the head of a unicorn, the head member 42 may include the head of virtually any animal or other figure. The head member 42 will preferably be filled with the same materials used to make the central core 30 of the support pillow 10. In this manner, the head member 42, will be soft and cushiony but will also be sufficiently rigid to be self-supporting. The support pillow 10 will also include a portion suitable for receiving a marking substance from a writing instrument as described in connection with FIG. 12.

Figure 10:
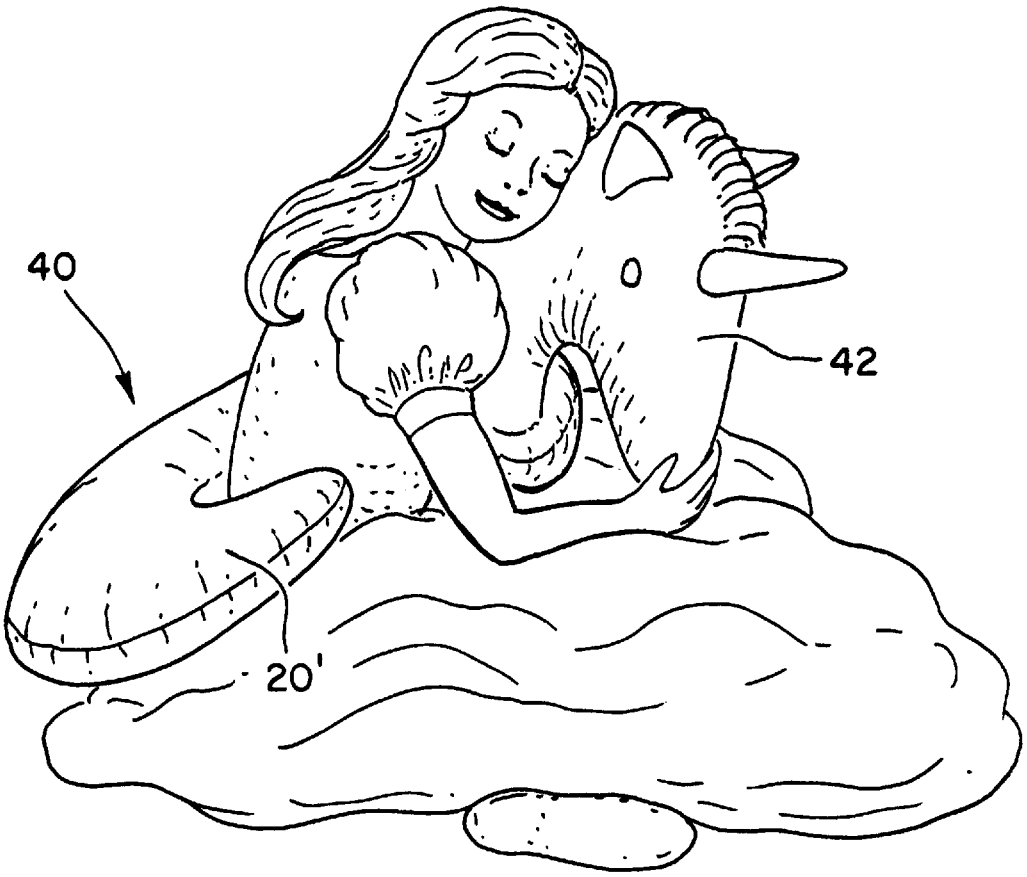
FIGS. 10 and 11 illustrate exemplary uses of the support pillow of FIG. 9.
Figure 11:
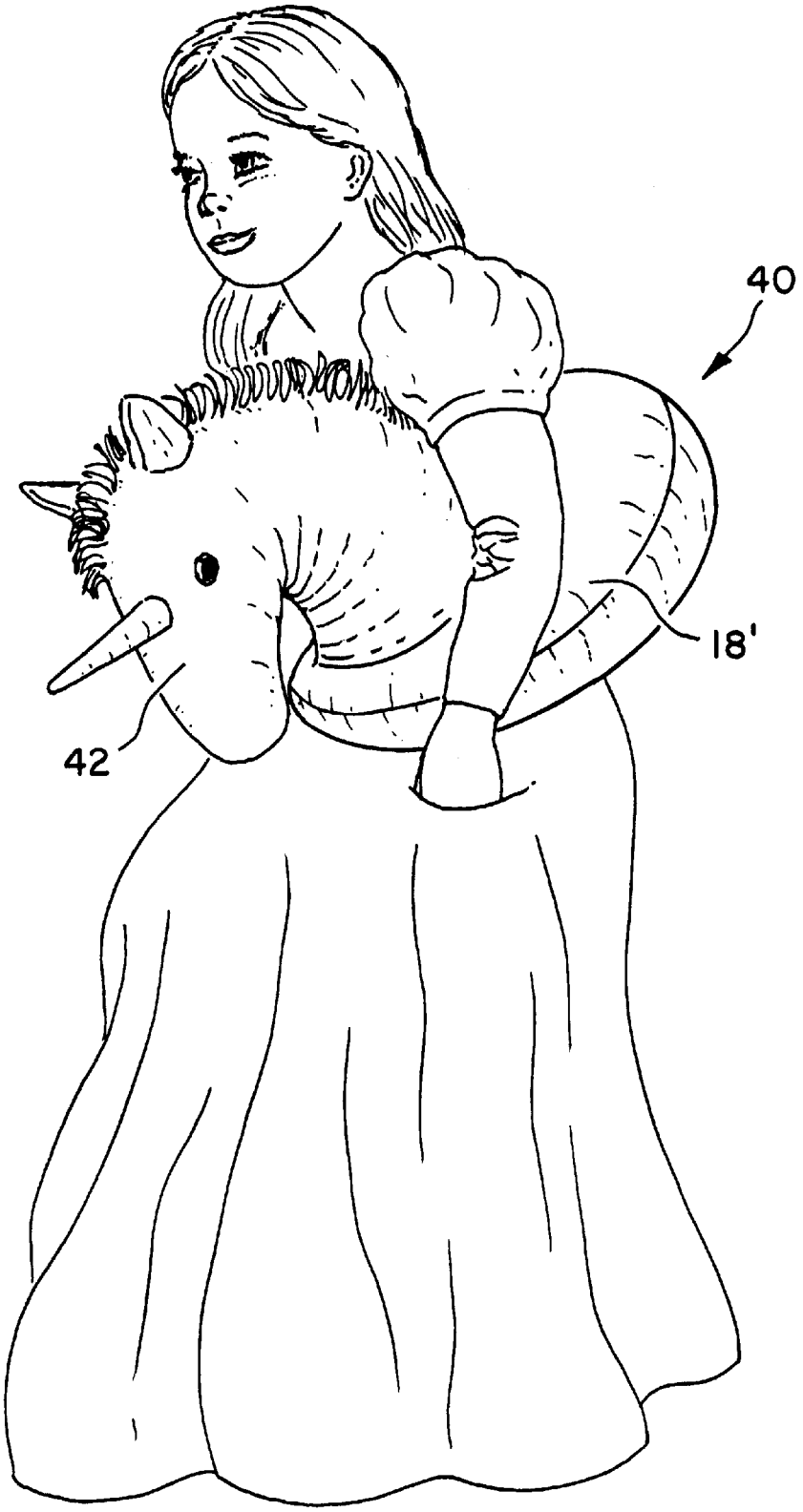

Referring now to FIGS. 10 and 11, exemplary uses of the support pillow 40 will be described. In FIG. 10, the support pillow 40 is placed around the person's torso with the cantilever arms 18', 20' being around the person's waist or lower torso, and with the head member 42 being in front of the person's torso. In this way the person may rest the head, neck, or chest on the head member when in a sitting position.

As illustrated in FIG. 11, the support pillow 40 may be placed around the person's torso when in the standing position. In this manner, the person may conveniently walk about with the support pillow 40 held around the torso, and with the head member 42 being at a comfortable viewing distance in front of the person. When the person sits, the support pillow 40 may be employed to rest his or her arms on the cantilever arms 18', 20'.

Referring to FIG. 12, a bottom portion 44 of the support pillow 40 is preferably constructed of a material which is suitable for receiving ink from a pen 46, marker, or similar writing instrument. Preferably, the bottom portion 44 will be constructed of a fabric having a smooth surface, such as satin, non-rip nylon, and the like. In this manner, the support pillow 40 may be used to receive autographs or other messages, such as when used at a slumber party, or to personalize the support pillow 40.

Referring to FIGS. 13 and 14, an exemplary device and method for storing and displaying a support pillow 50 will be described. Support pillow 50 includes a medial region 52 and two opposing arms 54 and 56, and may be constructed similar to the support pillows previously described herein. Surrounding medial region 52 is a central holder 58. Holder 58 preferably comprises a generally flexible material, such as cardboard, cardstock, plastic, and the like which is secured around medial region 52 to provide a convenient way to hold and display the support pillow 50. Preferably, holder 58 includes a tab 60 having an aperture 62 extending therethrough to enable the support pillow to be hung from a hanger 64 as shown in phantom line in FIG. 14.

Hence, by providing holder 58, support pillow 50 may be conveniently hung from a conventional hanger along an aisle of a retail store. Such a display is advantageous in that it reduces the amount of space required to store multiple support pillows. Further, by displaying the support pillow in this manner, purchasers are able to easily visualize the support pillow when passing down the aisle, therefore increases the chances for selling the pillow.

Upon removal from the hanger, a purchaser may simply remove holder 58, e.g., by tearing it from the support pillow, whereupon the support pillow 50 will be available for use. Optionally, a protective cover 66, such as a piece of clear plastic, may be provided over the support pillow 50 to protect the pillow from dirt and dust during storage. The protective cover 66 may simply be removed from pillow 50 prior to use.

Figure 15:
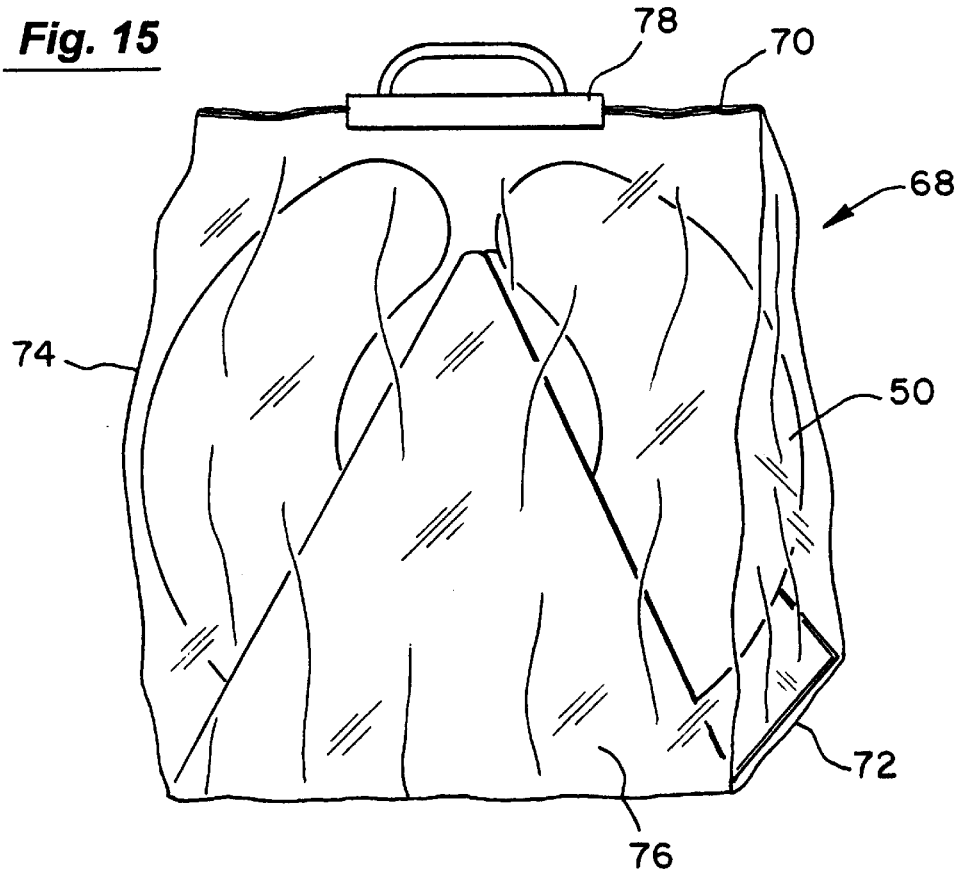
FIG. 15 is a front perspective view of a support pillow which is stored within a container according to the invention.

Referring now to FIG. 15, an exemplary container 68 for holding support pillow 50 will be described. Container 68 is constructed of a flexible material, such as a clear plastic, and has an open top end 70, a bottom end 72 and sides 74. Held within container 68 is a base member 76 which is preferably constructed of a rigid or semi-rigid material, such as cardboard or cardstock, which is folded so that it is flat on the bottom. In this way, when pillow 50 is placed in container 68, medial region 52 will rest on base member 76, which in turn will hold pillow 50 in a generally vertical orientation.

Conveniently, a snapable handle 78 is provided for carrying container 68. When snapped together, handle 78 also closes top end 70 to enclose pillow 50 within container 68. Hence, with such an arrangement, pillow 50 may conveniently be stored and displayed in a vertical orientation, while being able to be conveniently carried simply by grasping handle 78. To remove pillow 50 from container 68, handle 78 is separated and pillow 50 is lifted from container 68.

Figure 16:
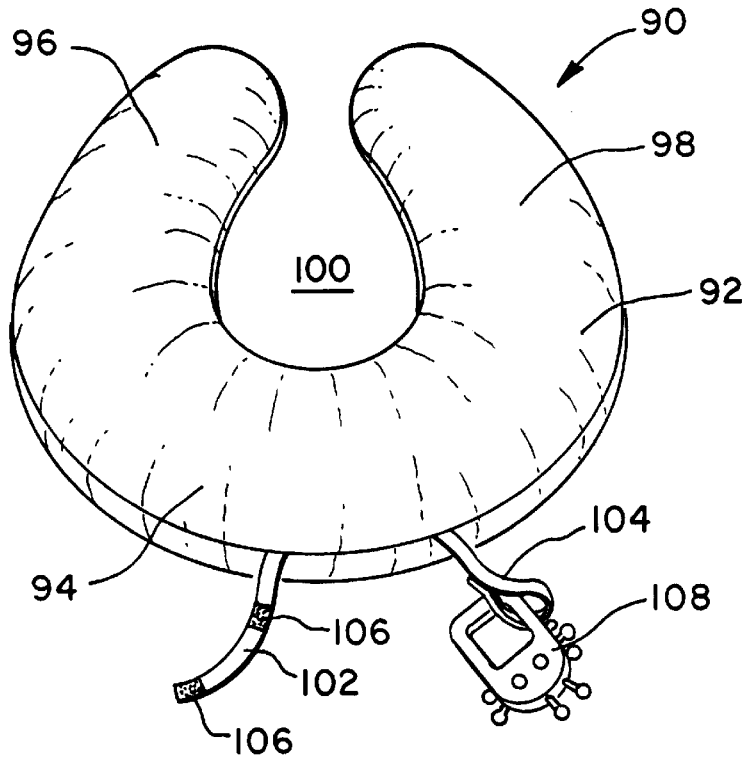
FIG. 16 is a top perspective view of a support pillow having a plurality of straps for attaching articles to the pillow according to the invention.

Referring now to FIG. 16, another exemplary embodiment of a support pillow 90 will be described. Support pillow 90 comprises a resilient cushion body 92 having a medial region 94 and two arms 96, 98 to define a generally open well 100. Support pillow 90 may be constructed similar to the other support pillows described herein.

Attached to medial region 94 are a pair of straps 102, 104, it being appreciated that other numbers of straps may be attached to the cushion body at other selective locations. Straps 102, 104 are preferably constructed of a strong, flexible material, such as cloth, nylon, and the like and may conveniently be sewn into the seam of the pillow body cover. As shown, each strap includes hook and loop fastener material 106, commonly sold under the tradename of Velcro (see strap 102). As best shown with strap 104, fastener material 106 allows strap 104 to be formed into a loop to hold a toy 108 to cushion body 98.

Although the fastener is shown as a hook and loop material, it will be appreciated that other attachment schemes may alternatively be provided. For example, toys could be attached by tying one or two straps around the toy. Alternatively, fasteners such as buckles, snaps, and the like could also be used with the straps.

In use, a child will preferably lay on the support pillow 90, with the stomach being generally over open well 100. The child's hands will then hang over medial region 94 so they are near straps 102 and 104. In this way, the toys held by the straps with always be within the child's reach. More specifically, the straps will prevent the child from pushing the toys out of reach during play and then becoming frustrated. In an alternative arrangement, the straps could be located at other areas on the pillow to allow the child to sit or lay in other orientations while playing with the toys. For example, the straps could be located on the arms to allow the child to lay across the arms or to sit in the well while playing with the toys.

Another advantage of the straps is that they allow for easy removal of the toys from the pillow. In this way, a variety of toys may be conveniently substituted so that the child will not become bored with the toys. Further, the toys may easily be removed for cleaning, repair or the like. The removable nature also allows the toys to be sold with the pillow as a system or a kit, or separately as replacement items.

Figure 17:
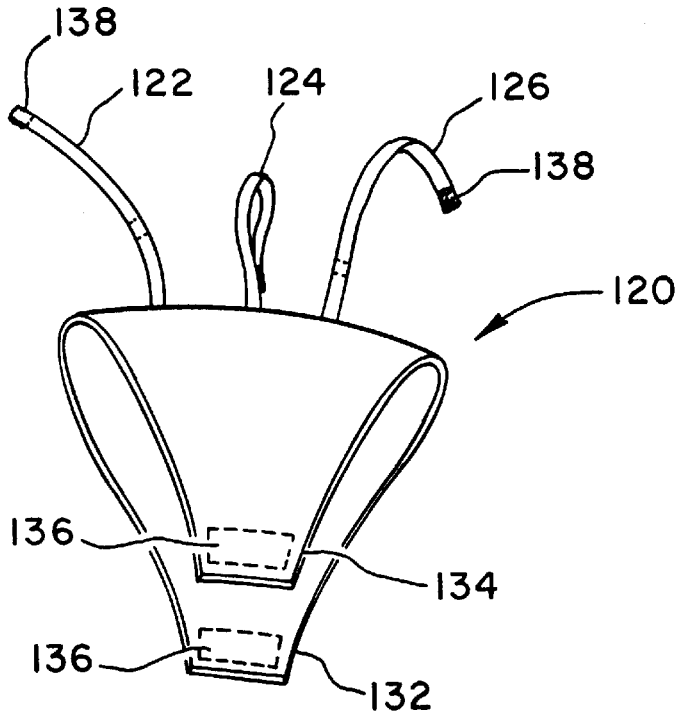
FIG. 17 is a perspective view of an exemplary cover having a plurality of straps for attaching articles to a support pillow according to the invention.
Figure 18:
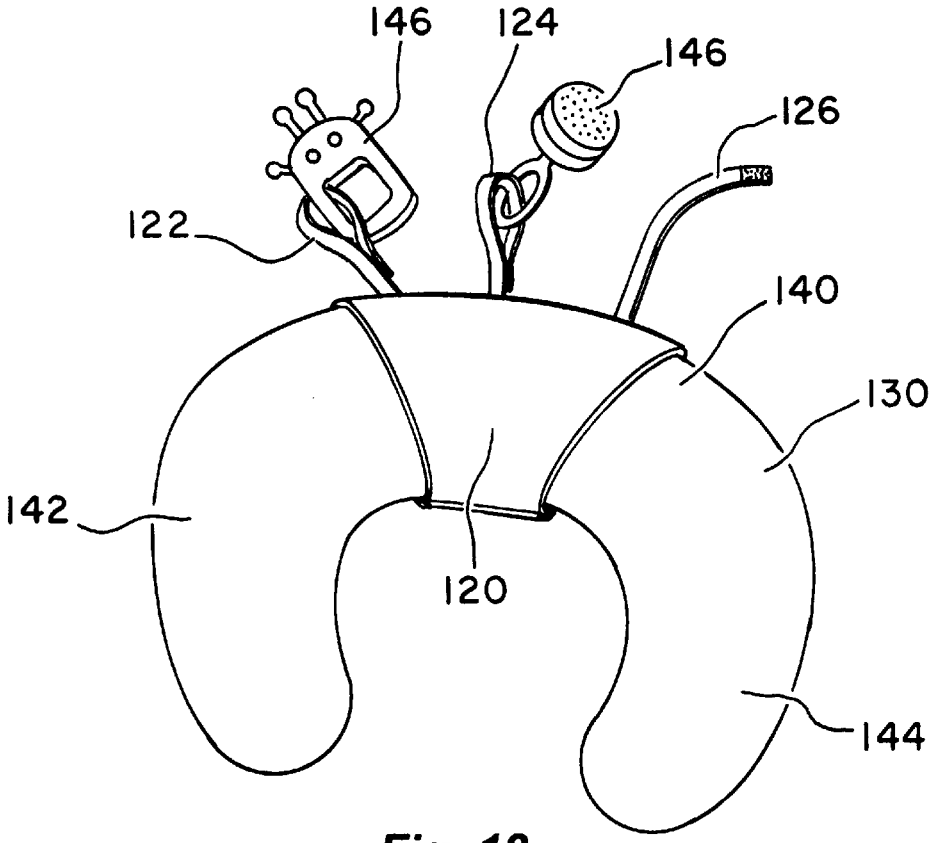
FIG. 18 illustrates the cover of FIG. 17 when coupled to a support pillow and showing toys coupled to the straps according to the invention.

Referring now to FIG. 17, a cover 120 having a set of straps 122, 124 and 126 will be described. Cover 120 is constructed of a flexible material, such as a fabric, plastic, or the like, and is configured to be removably attached about a support pillow 130 as shown in FIG. 18. Cover 120 includes a pair of ends 132 and 134 which overlap when cover 120 is placed around pillow 130. Ends 132 and 134 each include a hook and loop fastener material 136, such as Velcro, to secure ends 132 and 134 together when wrapped around pillow 130, although other fasteners may be used. Straps 122, 124 and 126 may be constructed similar to the straps of the previous embodiments. Straps 122, 124 and 126 are preferably sewn to cover 120 and preferably include a hook and loop fastener material 138 to allow for the attachment of various articles as described in connection with previous embodiments.

As shown in FIG. 18, cover 120 is placed about pillow 130. Pillow 130 is preferably constructed similar to the other pillows described herein and includes a medial region 140 and two arms 142 and 144. Cover 120 is disposed about medial region 140 so that straps 122, 124 and 126 are located at medial region 140 similar to other embodiments described herein. As shown, toys 146 are coupled to straps 122 and 124 in a manner similar to that previously described with other embodiments.

Use of cover 120 is advantageous in that it allows the straps to be removed from pillow 130 when not needed. Further, once removed cover 120 may easily be cleaned. For example, when constructed of a fabric, cover 120 may simply be placed in a washing machine. Another advantage is that cover 120 may be sold separately from a support pillow so that existing support pillows may easily be retrofitted to include straps.

Although shown as a cover which wraps about the pillow body, it will be appreciated that other arrangements are possible. For example, cover 120 may be configured to be placed about one of arms 142 or 144. Further, the size and shape of cover 120 may be modified. Also, the number and type of connectors that are attached to cover 120 may be varied similar to the other embodiments described herein.

It will also be appreciated that the straps (or other connectors) may be removably attached to the support pillow in other ways. For example, fasteners such as snaps may be employed to removably attach the straps directly to the support pillow.

Referring now to FIGS. 19 and 20, an exemplary embodiment of an attachment member 150 will be described. Attachment member 150 comprises a flexible cover 152 which is configured to be wrapped about a support pillow 154 as shown in FIG. 20. As such, cover 152 may be constructed similar to cover 120 as previously described and may optionally include various straps. Cover 152 includes a pair of fasteners 156 and 158, such as hook and loop fastener materials, snaps, or the like, to allow cover 152 to be removably attached about support pillow 154. Attached to cover 152 is a pocket 160 for holding various articles. Conveniently, pocket 160 may be constructed of fabric and sewn to cover 152. Optionally, pocket 160 may include a piece of an elastic material 162 which is incorporated into an opening of pocket 160 to assist in holding the articles within pocket 160.

As shown in FIG. 20, pocket 160 is holding a bottle 164. However, it will be appreciated that various other items may be held by pocket 160, including toys, pacifiers, baby care products, and the like. The arrangement of pocket 160 when cover 152 is attached about pillow 154 is particularly advantageous in that it provides easy and convenient access to the items. For example, when a child is lying in a prone position on pillow 154, bottle 164 will be just in front of the child's head and arms to allow bottle 164 to be easily removed by the child. The removable nature of attachment member 150 allows it to be washed or cleaned and allows for convenient filling of pocket 160 with various items.

Although cover 152 is shown as covering only the medial region of pillow 154, it will be appreciated that cover 152 may be moved to other locations. Further, cover 152 may be modified to cover the entire pillow. Still further, it will be appreciated that pocket 160 may be coupled directly to pillow 154 so that a cover is not needed.

The present invention has been described in detail. However, modifications and variations may occur to those skilled in the art without departing from the principles of the claimed invention. Therefore, the scope of the invention should be determined primarily with reference to the appended claims, along with a full scope of equivalents to which those claims are entitled by law.

What is claimed is:

1. A support pillow comprising:

a resilient cushion body that comprises a medial region and first and second arms extending from the medial region, said arms and medial region cooperating to define a generally circular open well;

an attachment member removably attached about the cushion body, the attachment member having at least one connector which is adapted to hold an article near the cushion body.

2. A pillow as in claim 1, wherein the attachment member comprises a flexible cover which is wrapped about at least a portion of the cushion body.

3. A pillow as in claim 2, wherein the attachment member includes a fastener, and wherein the cover is wrapped about itself to engage the fastener.

4. A pillow as in claim 3 , wherein the fastener comprises a hook and loop fastener material attached to two ends of the cover.

5. A pillow as in claim 2, wherein the connector comprises a strap having a fastener which allows the strap to be formed into a loop to secure the article to the attachment member.

6. A pillow as in claim 1, wherein the attachment member includes a plurality of connectors.

7. A pillow as in claim 1, wherein the attachment member is attached to the cushion body at the medial region, and wherein the article comprises a toy.

8. A support pillow comprising:

a resilient cushion body that comprises a medial region and first and second arms extending from the medial region, said arms and medial region cooperating to define a generally circular open well; and at least one strap removably attached to the cushion body which is adapted to hold an article near the cushion body.

9. A pillow as in claim 8, further comprising a plurality of straps attached to the cushion body.

10. A pillow as in claim 8, further comprising an attachment member which is removably attached to the cushion body, and wherein the strap is attached to the attachment member.

11. A pillow as in claim 10, wherein the attachment member comprises a flexible cover that is wrapped about the cushion body.

12. A pillow as in claim 8, wherein the strap includes a fastener which allows the strap to be formed into a loop to secure the article.

13. A method for attaching an article to a support pillow, the method comprising:

providing a support pillow comprising a resilient cushion body having a medial region and first and second arms extending from the medial region, said arms and medial region cooperating to define a generally circular open well;

wrapping a cover about the support pillow, the cover having at least one connector; and attaching an article to the cover with the connector.

14. A method as in claim 13, wherein the connector comprises a strap, and further comprising coupling the article to the strap.

15. A support pillow comprising:

a resilient cushion body that comprises a medial region and first and second arms extending from the medial region, said arms and medial region cooperating to define a generally circular open well;

an attachment member removably attached about the cushion body, the attachment member having at least one pocket which is adapted to receive and hold an article.

16. A pillow as in claim 15, wherein the attachment member comprises a flexible cover which is wrapped about at least a portion of the cushion body.

17. A pillow as in claim 16, wherein the attachment member includes a fastener, and wherein the cover is wrapped about itself to engage the fastener.

18. A pillow as in claim 14, wherein the fastener comprises a hook and loop fastener material attached to two ends of the cover.

19. A pillow as in claim 15, wherein the attachment member is attached to the cushion body at the medial region, and wherein the article comprises a bottle.

* * * * *